US009310755B2

(12) United States Patent
Mori

(10) Patent No.: US 9,310,755 B2
(45) Date of Patent: Apr. 12, 2016

(54) BELT AND DRAWER CONFIGURATION FOR AN IMAGE FORMING APPARATUS

(71) Applicant: Brother Kogyo Kabushiki Kaisha, Nagoya-shi, Aichi-ken (JP)

(72) Inventor: Hirotaka Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/449,196

(22) Filed: Aug. 1, 2014

(65) Prior Publication Data

US 2015/0037064 A1 Feb. 5, 2015

(30) Foreign Application Priority Data

Aug. 2, 2013 (JP) ..... 2013-161490

(51) Int. Cl.
*G03G 21/18* (2006.01)
*G03G 21/16* (2006.01)

(52) U.S. Cl.
CPC ..... *G03G 21/1619* (2013.01); *G03G 21/168* (2013.01); *G03G 21/1623* (2013.01); *G03G 21/1671* (2013.01); *G03G 2221/1684* (2013.01); *G03G 2221/1869* (2013.01)

(58) Field of Classification Search
CPC ..... G03G 21/1619; G03G 2221/1684
USPC ..... 399/110–113, 116, 117
See application file for complete search history.

(56) References Cited

U.S. PATENT DOCUMENTS

| | | | |
|---|---|---|---|
| 7,620,346 | B2 | 11/2009 | Nakano |
| 2003/0161656 | A1 | 8/2003 | Miura et al. |
| 2008/0038013 | A1 | 2/2008 | Nakano |
| 2010/0239271 | A1 * | 9/2010 | Kawamura et al. |
| 2012/0195633 | A1 * | 8/2012 | Okabe |

FOREIGN PATENT DOCUMENTS

| | | | |
|---|---|---|---|
| JP | H07-261493 | A | 10/1995 |
| JP | H08-171248 | A | 7/1996 |
| JP | 2000-259009 | A | 9/2000 |
| JP | 2000-275987 | A | 10/2000 |
| JP | 2003-316105 | A | 11/2003 |
| JP | 2004-077599 | A | 3/2004 |
| JP | 2008-046251 | A | 2/2008 |

* cited by examiner

*Primary Examiner* — Walter L Lindsay, Jr.
*Assistant Examiner* — Milton Gonzalez
(74) *Attorney, Agent, or Firm* — Banner & Witcoff, Ltd.

(57) ABSTRACT

An image forming apparatus has a plurality of photoconductive drums, a drawer configured to be movable with holding the plurality of photoconductive drums, a pair of frames arranged on both sides of the photoconductive drums. The frames have first supporting parts configured to movably support the drawer, a belt unit having an endless belt and a plurality of transfer members, first contacting parts respectively provided to the pair of frames, the first contacting parts contacting contacted parts provided to the drawer to position the drawer with respect to the pair of frames, and second contacting parts provided to the drawer, the second contacting part contacting second contacted parts provided to the belt unit to position the belt unit with respect to the drawer.

15 Claims, 9 Drawing Sheets

BELT AND DRAWER CONFIGURATION FOR AN IMAGE FORMING APPARATUS

CROSS-REFERENCE TO RELATED APPLICATION

This application claims priority under 35 U.S.C. §119 from Japanese Patent Applications No. 2013-161490 filed on Aug. 2, 2013. The entire subject matter of the application is incorporated herein by reference.

BACKGROUND

1. Technical Field

The following disclosure relates to an image forming apparatus employing an electrophotographic image forming method, and provided with a plurality of photoconductive drums.

2. Conventional Art

Conventionally, an electrophotographic image forming apparatus provided with a plurality of photoconductive drums has been known. Typically, the plurality of photoconductive drums are packaged as a photoconductive unit, and detachably accommodated in a casing of the image forming apparatus. Further, such an image forming apparatus has a belt unit having an endless belt which conveys a sheet inside the casing of the image forming apparatus. When such a photoconductive unit is attached to frames of a main body of the image forming apparatus, the belt unit typically receives a pressing force from a pressing part of the photoconductive unit, thereby the belt unit is urged to be located in place.

SUMMARY

According to the conventional image forming apparatus as described above, the photoconductive unit is positioned with respect to the frames or other parts of the main body. The belt unit is also positioned with respect to the main body. In such a configuration, if the image forming apparatus is placed at a slanted place, the frames may be distorted.

When the frames are distorted, the belt which is positioned with respect to the frames may also be distorted. In such a case, the endless belt may proceed obliquely. When the belt proceeds obliquely, end portions of the endless belt may frictionally contact other members/portions and may be deteriorated relatively early due to the friction.

According to aspects of the illustrative embodiments, there is provided an image forming apparatus having a plurality of photoconductive drums arranged along an arranging direction. Rotation axes of the photoconductive drums are arrange in parallel. The image forming apparatus further has a drawer configured to be movable with holding the plurality of photoconductive drums, and a pair of frames arranged on both sides in an axial direction of the plurality of photoconductive drums. The pair of frames have first supporting parts configured to movably support the drawer. The image forming apparatus further has a belt unit having an endless belt configured to proceed in the arranging direction. The endless belt has an extending surface configured to contact the plurality of photoconductive drums and a plurality of transfer members. There are first contacting parts respectively provided to the pair of frames, and configured to contact contacted parts which are provided to the drawer to position the drawer with respect to the pair of frames, and second contacting parts provided to the drawer, configured to contact second contacted parts which are provided to the belt unit to position the belt unit with respect to the drawer.

BRIEF DESCRIPTION OF THE ACCOMPANYING DRAWINGS

DETAILED DESCRIPTION OF THE EMBODIMENTS

Hereinafter, referring to the accompanying drawings, illustrative embodiments according to the invention will be described. It is noted that the illustrative embodiments merely show examples to which the invention is applied and the invention should not be limited to the configurations of the illustrative embodiments.

In the following description, arrows indicated in each drawing are intended to clarify positional relationship among the drawings, and are not intended to limit the orientation of image forming apparatus to the indicated directions. Further, in the description hereinafter, unless explicitly recited with terms "a plurality of" or "more than one", a member or a part assigned with a reference number should be considered such that there is "at least one" of such a member or a part.

Figure 1:
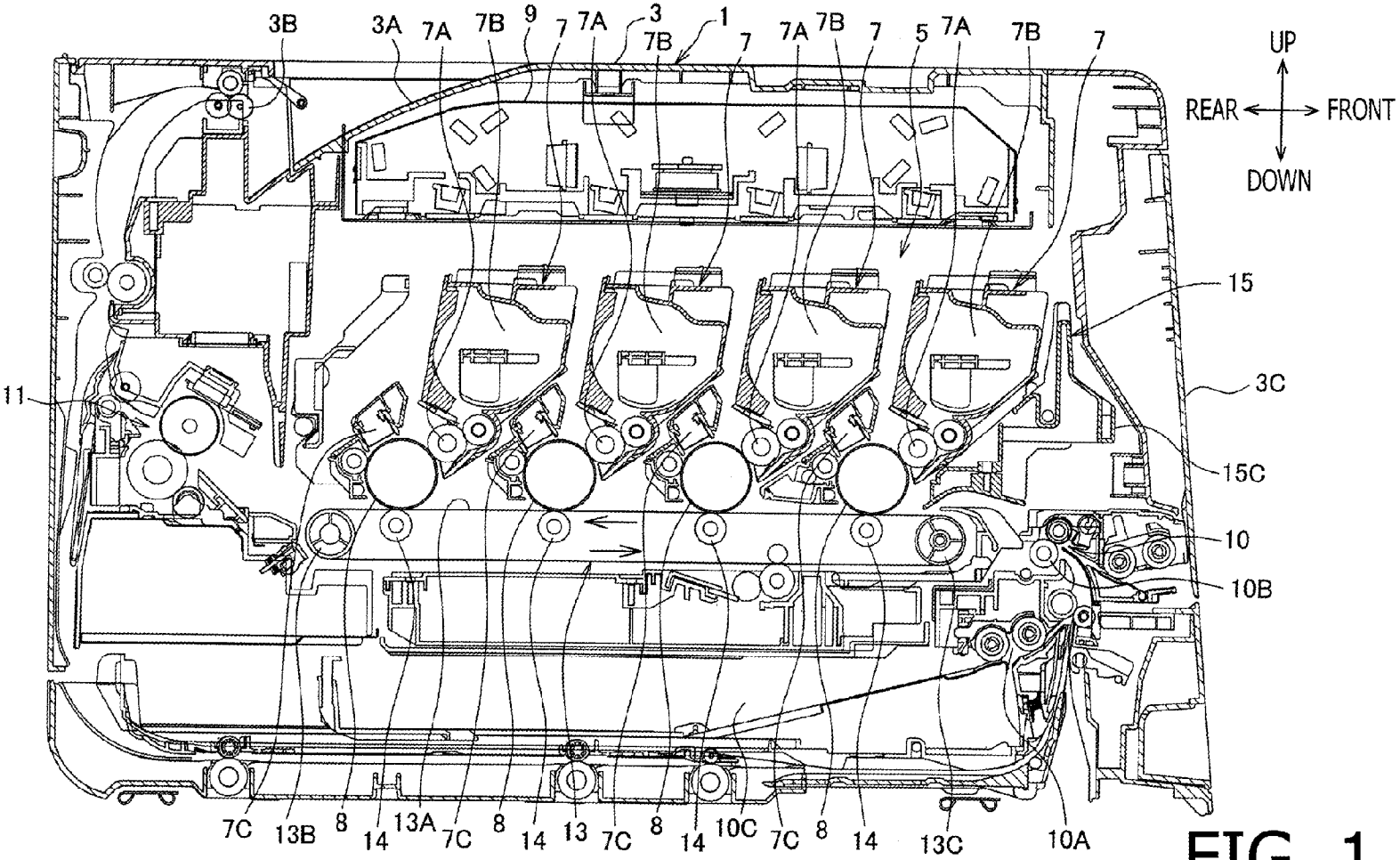
FIG. 1 is a cross-sectional side view of an image forming apparatus according to first illustrative embodiment of the present invention.

An image forming apparatus 1 according to a first illustrative embodiment has a casing 3, a feeder mechanism 10, an image forming unit 5 and a belt unit 20 (see FIG. 1). The image forming unit 5 forms an image on a sheet in accordance with an electrophotographic image forming method. The image forming unit 5 has plurality of developing cartridges 7, a plurality of photoconductive drums 8, an exposure unit 9 and a fixing unit 11, and is configured to form a color image.

Each developing cartridge 7 has a developing roller 7A and a reservoir 7B which reserves developing agent. The plurality of developing rollers are arranged such that the rotation axes thereof are parallel with each other. Further, the plurality of developing rollers are arranged in a direction substantially perpendicular to the extending direction of the rotation axes thereof (i.e., in a front-and-rear direction). In the following description, a direction parallel to the direction in which the plurality of developing rollers are arranged (i.e., the front-and-rear direction) will occasionally be referred to as an arranging direction. As mentioned above, according to the first illustrative embodiment, the arranging direction coincides with the front-and-rear direction.

In the reservoirs 7B of the developing cartridges 7, black, cyan, magenta and yellow developing agents are reserved, respectively, from a first side in the arranging direction (i.e., the rear side) to a second side, which is an opposite side, in the arranging direction (i.e., the front side).

Corresponding to the plurality of developing cartridges 7, the same number of photoconductive drums 8 and chargers 7C are provided (FIG. 1). Each photoconductive drum 8 is a cylindrical member configured to carry the developing agent. The plurality of photoconductive drums 8 are arranged such that the rotation axes thereof are parallel to each other and arranged in the arranging direction (i.e., the front-and-rear direction). The charging units 7C are configured to charge the corresponding photoconductive drums 8, respectively.

The exposure unit 9 is used to expose circumferential surfaces of the photoconductive drums 8 having been charged by the charging units 7C so that an electrostatic latent image is formed on each of the photoconductive drums 8. The developing rollers 7A supply the developing agents reserved in the reservoirs 7B, respectively, to develop the electrostatic latent images. Then, on the circumferential surfaces of the photoconductive drums 8, developed images corresponding to the electrostatic latent images are held, respectively.

The belt 13 is an endless belt bridges and wound around a driving roller 13B and a driven roller 13C. Rotation axes of the driving roller 13B and the driven roller 13C are parallel with the rotation axes of the photoconductive drums 8.

When the belt rotates (i.e., proceeds), a bridging surface (i.e., a horizontally extending surface) 13A facing the plurality of photoconductive drums 8 proceeds from the second side to the first side in the arranging direction (i.e., from the front side to the rear side). The bridging surface 13A is parallel with the arranging direction and the axes of the photoconductive drums.

On an upstream side with respect to the belt 13, a feeder mechanism 10 is arranged. The feeder mechanism 10 is configured to feed the sheets placed on a sheet tray 10C toward the image forming unit 5. The feeder mechanism 10 has a feeder roller 10A and a registration roller 10B.

The feeder roller 10A is configured to feed the sheets on the sheet tray 10C toward the image forming unit 5 one by one.

A leading end of the sheet fed by the feeder roller 10A is caught by the registration roller 10B so that the leading end is aligned against the registration roller 10B, and then conveyed onto the bridging surface 13A of the belt 13 at a predetermined timing.

At positions opposing the photoconductive drums 8 with the bridging surface 13A of the belt 13 located therebetween, transfer members 14 are arranged. Each transfer member 14 is configured such that, when a transfer bias is applied, the developed image (i.e., developing agent) held on the circumferential surface of the photoconductive drum 8 is transferred onto the sheet which is held and conveyed by the bridging surface 13A of the belt 13.

With the above mechanism, the developed images on the photoconductive drums 8 are transferred on one sheet in an overlaid manner. The fixing unit 11 applies pressure and heat to the developing agent image transferred onto the sheet, thereby the developing agent image is fixed onto the sheet. After the image is thus formed, the sheet is discharged from the image forming apparatus by a discharge roller 3B and the like, and stacked on a sheet discharge tray 3A formed on an upper surface of the casing 3.

Figure 2:
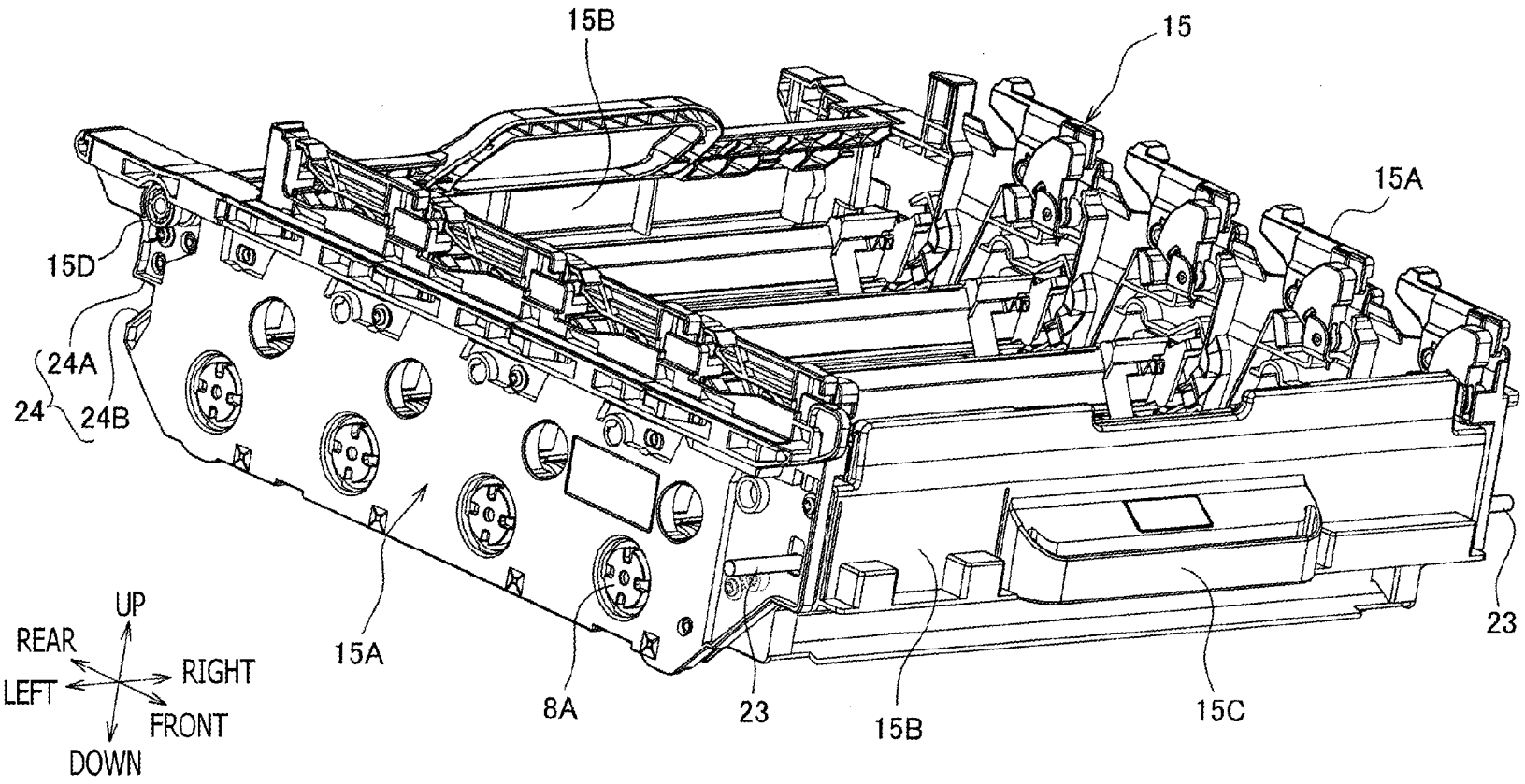
FIG. 2 is a perspective view of a drawer of the image forming apparatus shown in FIG. 1.

Each photoconductive drum 8 is positioned with respect a drawer 15 (see FIG. 1). The drawer 15 is an upwardly opened box-shaped member (FIG. 2). The drawer 15 has side walls 15A arranged on both sides of a portion at which the developing cartridges 7 are arranged, and a plurality of bridging members 15B each of which is bridges between the side walls 15A.

The plurality of developing cartridges 7 are detachably attached to the drawer 15 via the opening of the drawer 15. Each photoconductive drum 8 has, on its end parts in the direction of the rotation axis, flange parts 8A. The flange parts 8A are rotatably positioned with respect to the side walls 15A.

The drawer 15 is configured to be movable with respect to the main body of the image forming apparatus. A movable direction of the drawer 15 is a horizontal direction, which is parallel with the arranging direction. The term main body means portions of the image forming apparatus which are not exchangeable by the user (e.g., the main frames 17 and the like).

Figure 3:
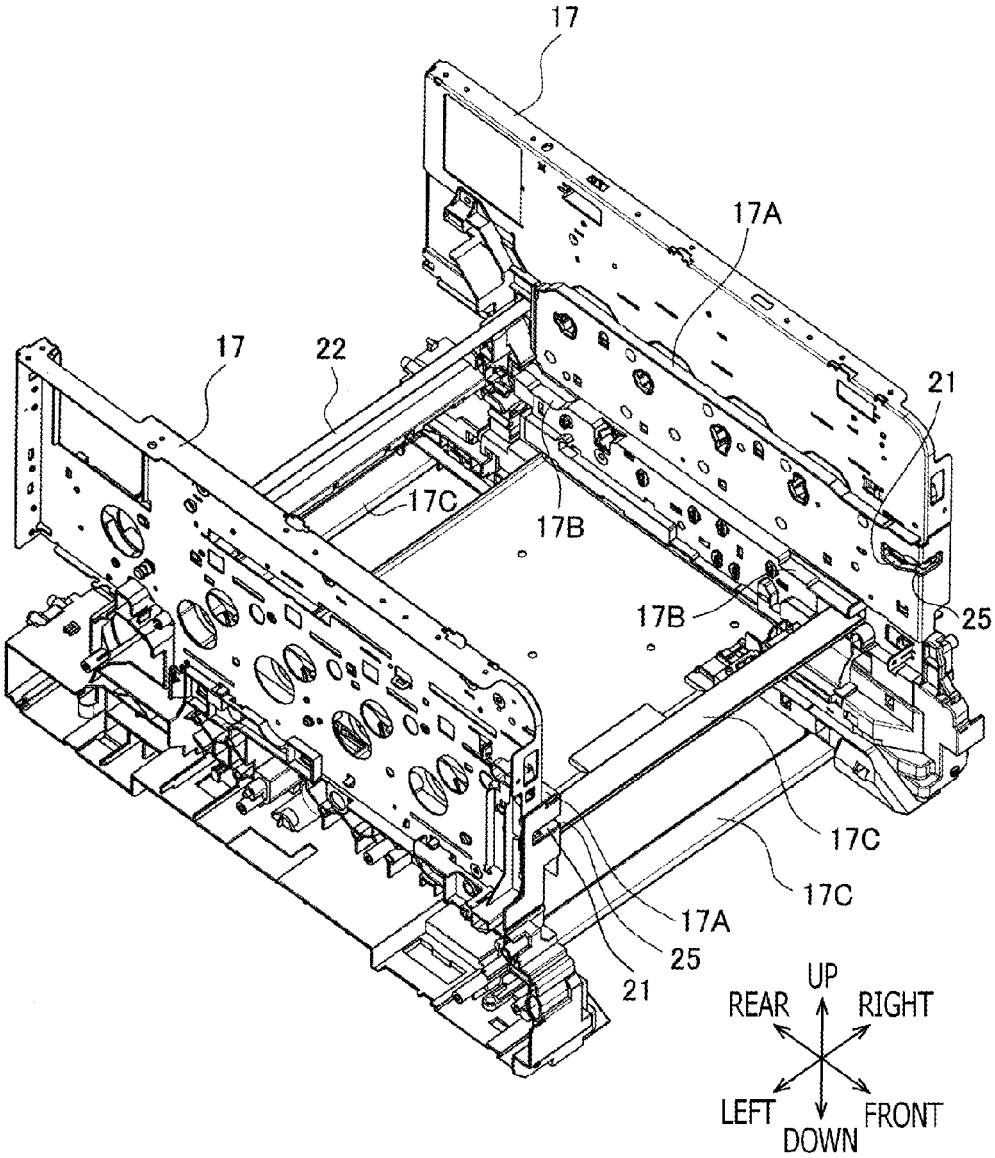
FIG. 3 is a perspective view of a main frame of the image forming apparatus shown in FIG. 1.

The main frames 17 are arranged on both sides in the axial direction of the photoconductive drums 8, on the side wall 15A sides with respect to the photoconductive drums 8. The main frames 17 are connected with a plurality of beam frames 17C and the like as shown in FIG. 3. According to the first illustrative embodiment, each of the main frames 17 is a plate-like member substantially covering the corresponding side wall 15A. Further, the main frames 17 are strengthened members and configured to support the drawer 15 and exposure unit 9.

As shown in FIG. 1, the casing 3 has an openable/closable cover 3C on its front part. When the drawer 15 is moved frontward and drawn out of the main body with the cover 3C being opened, the plurality of developing cartridges 7 can be detachable from the drawer 15.

When the drawer 15 in the drawn state is moved rearward, that is moved to a coupling direction, the drawer 15 is coupled to the main body. The drawer 15 is provided with a handle part 15C which a user can grip.

As described above, by moving a drawer 15, the plurality of developing cartridges 7 can be moved such that they are drawn out of the main body. Because of such a structure, the plurality of cartridges 7 which can be handled integrally via the drawer 15 will also be referred to as a drawer unit hereinafter.

Each main frame 17 is provided with a first supporting part 17A which movably supports the drawer 15 (see FIG. 3). The first supporting parts 17A constitute a pair of rails extending in the arranging direction. The drawer 15 is provided with wheels 15D which revolve and move on the pair of first supporting parts 17A (i.e., the pair of rails).

Figure 4:
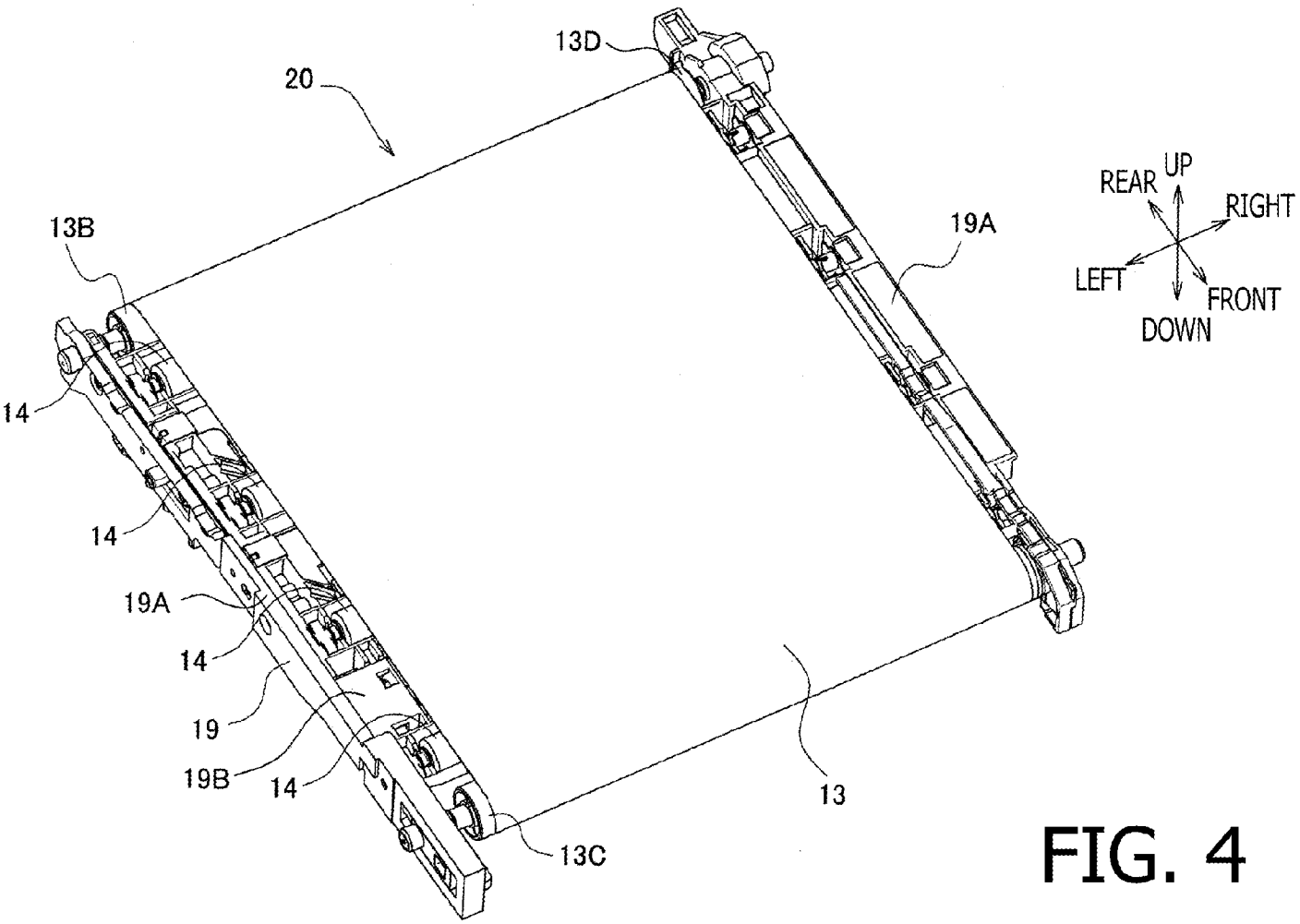
FIG. 4 is a perspective view of a belt unit of the image forming apparatus shown in FIG. 1.

The belt 13, the driving roller 13B, the driven roller 13C and the transfer member 14 are integrally assembled to a frame 19 (see FIG. 4) to constitute a belt unit 10. The belt unit 20 is detachably accommodated inside the casing 3.

A rotating force is applied to the driving roller 13B and the driving roller 13B moves the belt 13 to rotate (i.e., proceed). As the belt 13 proceeds, the driven roller 13C is driven by the belt 13 to rotate. Further, the driven roller 13C is urged in a direction separating from the driving roller 13B, thereby causing a tensile force which is applied to the belt 13.

The frame 19 includes a pair of roller supporting frames 19A which rotatably supports axial end portions of the driving roller 13B, the driven roller 13C, and a connecting frame 19B which connects the pair of roller supporting frames 19A and extends in the axial direction.

When the degree of parallelization of the (pair of) supporting frames 19A changes, the belt 13 may proceeds obliquely. If the belt 13 proceeds obliquely, an end part in the axial direction (i.e., the width direction) may frictionally contacts the flange part 13D formed to the driving roller 13B with moving in the arranging direction, thereby degree of oblique proceeding of the belt 13 can be restricted by the flange part 13D.

When the image forming apparatus 1 is in a state of forming an image on the sheet (i.e., when assembling of the image forming apparatus 1 has been completed), such a state will be referred to as an assembling completed state, the drawer 15 is supported by the main frames 17 with being positioned with respect to the main frames 17, and the belt unit 20 is supported by the drawer 15 with being positioned with respect to the drawer 15.

The main frames 17 are provided with first contact parts 21 and 22 which are used to position the drawer 15 with respect to the main frames 17 (see FIG. 3). The first contacting part 22 is provided on the first side (rear side according to the illustrative embodiment) in the arranging direction.

The first contact part 21 is provided on the second side (front side according to the first illustrative embodiment) in the arranging direction of each frame 17. In the following description, the first contact parts 21 will be referred to as first front contact parts 21, and the first contact part 22 will be referred to as the first rear contact part 22.

The drawer 15 is formed with first contacted parts 23 and 24 which the first contact parts 21 and 22 contact, respectively. The first contacted part 24 formed on the first side in the arranging direction (i.e., a rear side in the first illustrative embodiment) contacts the first rear contact part 22 in the assembling completed state, that is, when the image forming apparatus is in condition for executing an image formation.

The first contacted parts 23 formed on the second side in the arranging direction (i.e., on the front side) contact the first front contact parts 21. In the following description, the first contacted part 24 will be referred to as the first rear contacted part 24, and the first contacted parts 23 will be referred to as the first front contacted parts 23.

Thus, when the image forming apparatus 1 is in the assembling completed state, the first rear contact parts 22 contact the first rear contacted parts 24, while the first front contact part 21 contact the first front contacted part 23, thereby a relative position of the drawer 15 with respect to the pair of main frames 17 is determined.

The first rear contact part 22 is a cylindrical (hollow or solid) member bridging between the pair of main frames 17 (FIG. 3). The first rear contacted part 24 includes an opening part which is opened toward a direction in which the drawer 15 moves to the proceeding side in the coupling direction. Such an opening is configured such that a leading portion on the proceeding side in the coupling direction of the drawer 15 is widely opened than a trailing portion in the retracting side in the coupling direction of the drawer 15.

Figure 5B:
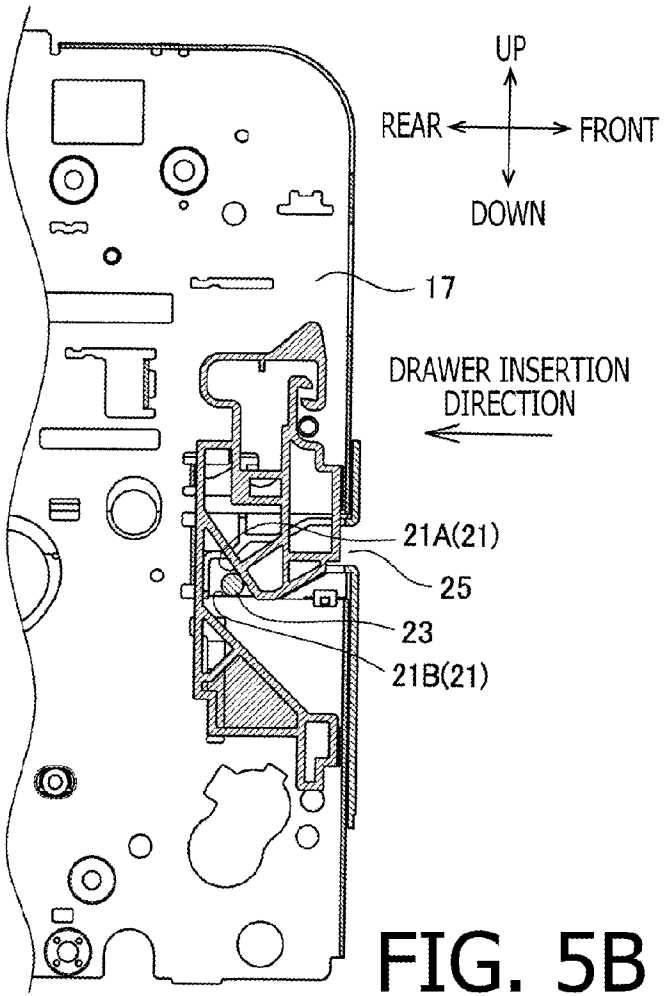
FIG. 5B is a side view of a front end part of the main frame to which the drawer is assembled.
Figure 5A:
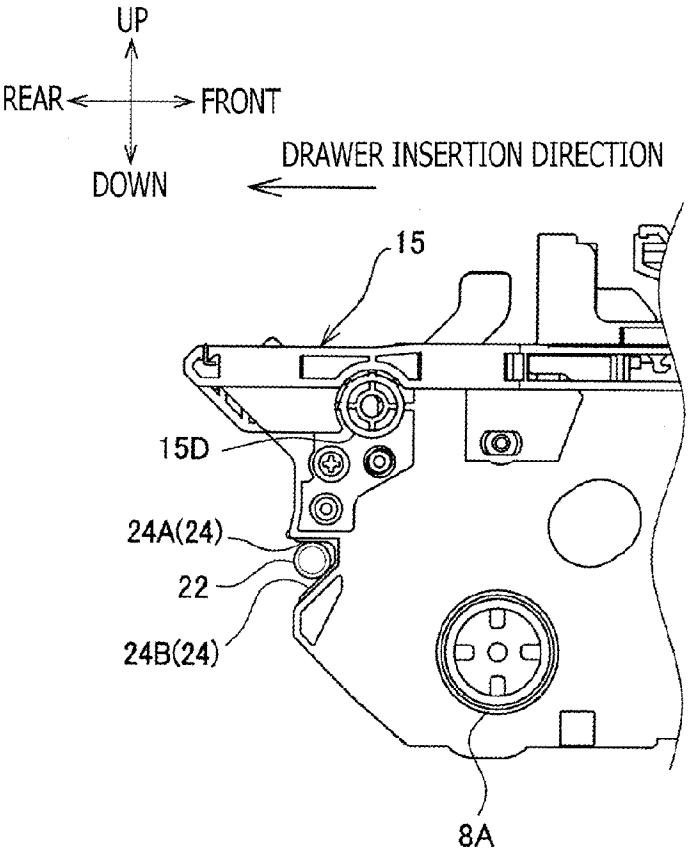
FIG. 5A is a side view of a rear end part of the drawer of the image forming apparatus shown in FIG. 1.

Specifically, the first rear contacted part 24 has a first part 24A and a second part 24B which contact the first rear contact part 22 with sandwiching the same (FIG. 5A). The first part 24A contacts the first rear contact part 22 from one side in a direction perpendicular to the bridging surface 13A (i.e., up-and-down direction according to the first illustrative embodiment).

A plane of the second part 24B is inclined with respect to the first part 24A and intersects a plane of the first part 24A. The second part 24B contacts the first rear contact part 22 from the other side in the direction perpendicular to the bridging surface 13A. Due to the above structure, when the first rear contact part 22 contacts the first part 24A and the second part 24B, the drawer 15 is unable to displace toward the proceeding side in the coupling direction. In other words, the first rear contact part 22 and the first rear contacted part 24 at least have a function of positioning the drawer 15 in the arranging direction.

It is noted that, according to the first illustrative embodiment, the first part 24A and the second part 24B of the first rear contacted part 24 contact the first rear contact part 22 with sandwiching the same from un and down directions. Therefore, the first rear contact part 22 and the first rear contacted part 24 also have a function of positioning the drawer 15 in the up-and-down direction.

The first front contacted parts 23 are cylindrical (hollow or solid) members protruded from the drawer 15 toward the main frames 17, respectively (see FIG. 2). Each of the main frames 17, grooves 25 in/from which the first front contacted parts 23 can be inserted/removed (see FIG. 3). The grooves 25 extends from the second side (the front side in the first illustrative embodiment) to the first side (the rear side in the first illustrative embodiment) in the arranging direction.

The first front contact part 21 is formed on the first side in the arranging direction of each groove 25 (see FIG. 5B). Specifically, the first front contact part 21 includes a first part 21A and a second part 21B which contact the first front contacted part 23 with sandwiching the same.

The first part 21A displaces in the direction perpendicular to the bridging surface 13A (i.e., in the up-and-down direction in the first illustrative embodiment) in association with an opening/closing movement of the cover 3C, and is configured to contact the first front contacted part 23 from one side of the direction perpendicular to the bridging surface 13A.

Specifically, when the cover 3C is opened, the first part 21A is moved away from the first front contacted part 23, while when the cover 3C is closed, the first part 21A approaches the first front contacted part 23 from the above and contacts the same.

The second part 21B unmovable part provided to each main frame 17, and contacts the first front contacted part 23 from the other side (from the below according to the first illustrative embodiment) in the direction perpendicular to the bridging surface 13A. The second part 21B extends in the direction same as the coupling direction of the drawer 15. The first part 21A is inclined to be spaced farther from the second part 21B toward the proceeding side in the coupling direction.

With the above structure, when the cover 3C is closed, the first parts 21A push the drawer 15 toward the proceeding side in the coupling direction (i.e., toward the first rear contacting part 22 side) with urging the first front contacted parts 23 to contact the second parts 21B. Therefore, the first front contacting parts 21 and the first front contacted parts 23 function to determine the relative position of the drawer 15 with respect to the main frames 17 in the direction perpendicular to the bridging surface 13A.

The drawer 15 is provided with second contacting parts 26 and 27 which are used to position the belt unit 20 with respect to the drawer 15. The second contacting parts 27 are provided on the first side in the arranging direction (i.e., on the rear side according to the present embodiment).

The second contacting parts 26 are arranged on the second side in the arranging direction (i.e., on the front side, according to the first illustrative embodiment). In the following description, the second contacting parts 27 will be referred to as the second rear contacting parts 27, and the second contacting parts 26 will be referred to as the second front contacting parts 26.

The second rear contacting part is arranged on a rear side with respect to the plurality of the photoconductive drums 8. The second front contacting parts 26 are arranged on the front side with respect to the plurality of photoconductive drums 8.

The belt unit 20 is provided with second contacted parts 28 and 29 which respectively contact the second contacting parts 26 and 27. The second contacted parts 29, which are arranged on the second side in the arranged direction, contact the second rear contacting parts 27 when the belt unit 20 is assembled in the image forming apparatus 1.

The second contacted parts 28, which are arranged on the second side in the arranging direction, contact the second front contacting parts 26 when the belt unit 20 is assembled in the image forming apparatus 1. In the following description, the second contacted parts 29 will be referred to as the second rear contacted parts 29, and the second contacted parts 28 will be referred to as the second front contacted parts 28.

That is, when assembling of the belt unit 20 is completed, the second rear contacting parts 27 contact the second rear contacted parts 29, and the second front contacting parts 26 contact the second front contacted parts 28, thereby a relative position of the belt unit 20 is adjusted with respect to the drawer 15.

The belt unit 20 has protruded members at rear end part thereof. Each of the protruded members protrudes from the belt unit toward the adjacent main frame 17. The second rear contacted parts 29 are defined as surfaces on the second side in the arranging direction (i.e., rear side surfaces) of the protruded members, respectively. Specifically, according to the first illustrative embodiment, the second rear contacted parts 29 are provided to bearings of the driving roller 13B (see FIG. 6).

The second rear contacting parts 27 are surfaces which intersect with the arranging direction. When the second rear contacting parts 27 contact the second rear contacted part 29, respectively, a relative position, in the arranging direction, of the belt unit 20 with respect to the main frames 17 is determined (see FIGS. 6 and 7).

The second front contacted parts 28 are protruded parts which are protruded from the belt unit 20 toward the adjacent main frames 17, respectively. According to the first illustrative embodiment, the second front contacted parts 28 are provided to the frames 19, respectively. Further, each of the second front contacted parts 28 is arranged on the driven roller 13C with respect to the plurality of transfer members 14 located therebetween.

Each of the second front contacting parts 26 has a first part 26A and a second part 26B, which contact the second front contacted part 28 with sandwiching the second front contacted part 28 in a direction perpendicular to the bridging surface 13A (i.e., the up-and-down direction in the first illustrative embodiment).

According to the above structure, each of the second front contacted parts 28 is restricted from displacing in the up-and-down direction as the first part 26A and the second part 26B contact the second front contacted part 28. In other words, the second front contacting parts 26 and the second front contacted parts 28 determine a relative position of the belt unit 20 in the up-and-down direction.

Figure 6:
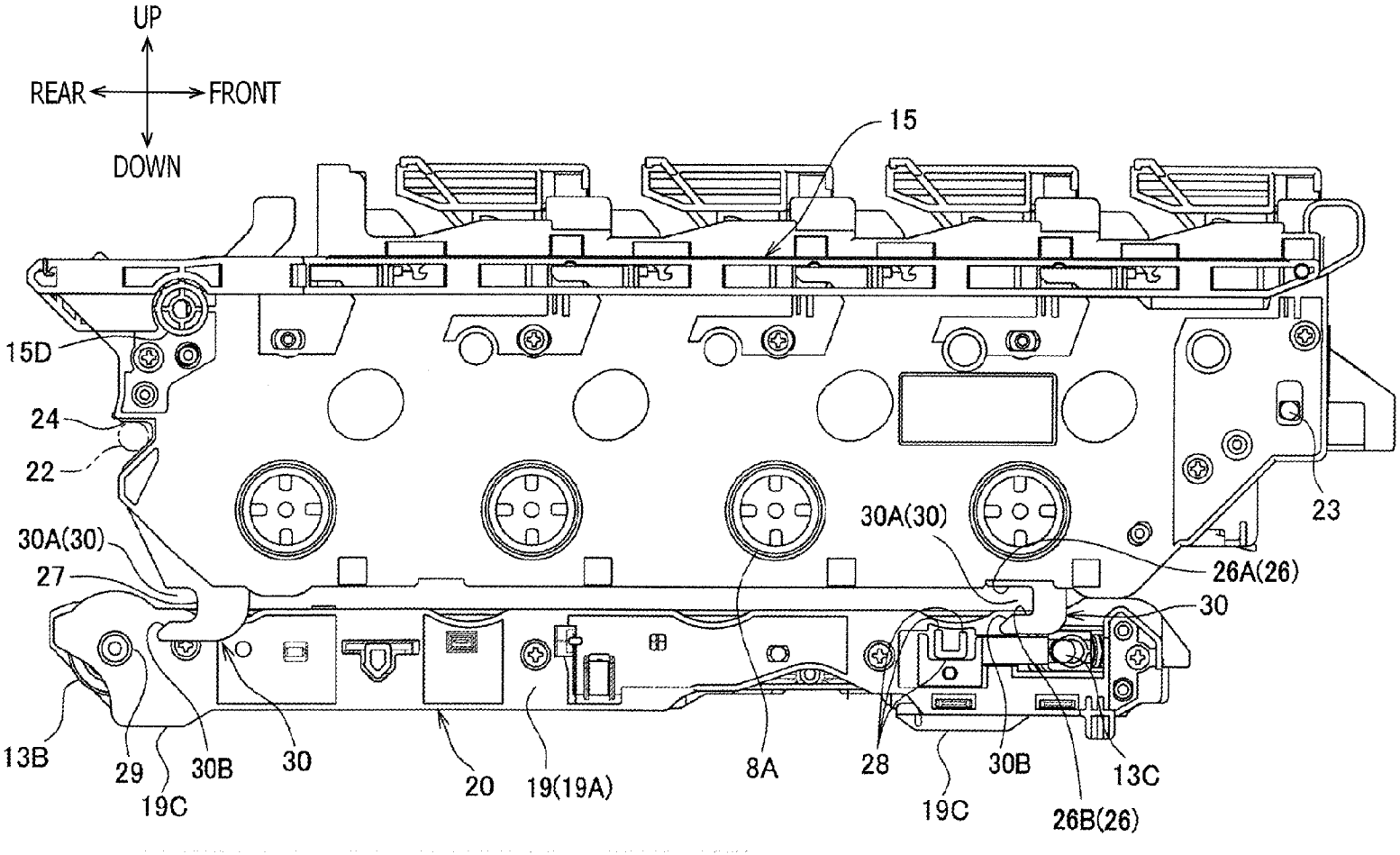
FIG. 6 is a side view showing the drawer to which the belt unit has not been coupled.

The second contacting parts 26 and 27 are provided to hook parts 30 which are protruded downward from the side walls 15A of the drawer 15 (see FIG. 6). Each of the hook parts 30 is a C-shaped part having an opening 30A directed to the proceeding side in the coupling direction (i.e., on the first side in the arranging direction).

The second rear contacting parts 27 are provided to the second side in the arranging direction (i.e., front side surfaces) of the hooks 30 provided at the first side in the arranging direction (i.e., at the rear side) of the side walls 15A. The second front contacting parts 26 are provided to portions extending in the arranging direction from the openings 30A of the hooks 30 provided on the second side in the arranging direction (i.e., at the front side) of the side walls 15A.

When the belt unit 20 has been coupled to the drawer 15, the second contacted parts 28 and 29 enter the openings 30A, engage with the hooks 30 and contact the second contacting parts 26 and 27, respectively. Thus, the hooks 30 functions as the second supporting parts which supports the belt unit 20 when the second contacting parts 26 and 27 contact the second contacted part 28 and 29, respectively.

Each hook 30 has an inclined surface 30B which is inclined with respect to the arranging direction. The inclined surface 30B serves as a guiding surface to guide the second contacted parts 28 and 29 toward the proceeding side in the insertion direction (i.e., the second side in the arranging direction) when the second contacted parts 28 and 29 are fitted in the hooks 30, respectively. Because of the inclined surface 30B, each opening 30A is formed such that a retracting side in the insertion direction (i.e., the first side in the arranging direction) is opened wider than the front portion.

As described above, according to the first illustrative embodiment, when the first contacting parts 21 and 22 contact the first contacted parts 23 and 24, the second contacting parts 26 and 27 contact the second contacted parts 28 and 29.

In other words, when assembling of the image forming apparatus 1 is completed, the first contacting parts 21 and 22 contact the first contacted parts 23 and 24. As a result, the drawer 15 is supported by the main frames 17 with being positioned with respect to the main frames 17. Further, the second contacting parts 26 and 27 contact the second contacted parts 28 and 29. As a result, the belt unit 20 is supported by the drawer 15 with being positioned with respect to the drawer 15.

When the belt unit 20 is not supported by the hooks 30 (e.g., when the drawer is drawn out of the main body), the belt unit 20 is supported by the third supporting parts 17B (FIG. 3) provided to the main frames 17.

As shown in FIG. 3, a plurality of third supporting parts 17B are provided to each main frame 17. The third supporting parts 17B support a plurality of supported protrusions 19C, which are protruded downward from the roller supporting frames 19A of the belt unit 20, from the below, respectively.

According to the first illustrative embodiment, the belt unit 20 is positioned relative to the drawer 15, and is not positioned directly to the pair of main frames 17. Therefore, even if the main frames 17 are distorted, direct affect of the distortion of the main frames 17 to the belt unit 20 can be suppressed.

Accordingly, it is possible to suppress the belt unit 20 from being largely distorted in association with the distortion of the main frames 17. Further, it is possible to suppress the belt 13 from being damaged at an early stage by suppressing the belt 13 from proceeding obliquely.

According to the first illustrative embodiment, the first supporting part 17A is configured to allow the drawer 15 to move in the arranging direction of the plurality of photoconductive drums 8. It is noted that the drawer 15 being movable in the arranging direction means that the drawer 15 being movable along the main frames 17 if the pair of main frames 17 are configured with a pair of plate-like members, respectively.

Further, if the drawer 15 is movable along the main frames 17, it becomes unnecessary to form openings through which the drawer 15 passes on the frames 17. Therefore, it is possible to prevent lowering of rigidity of the main frames 17.

Therefore, even if the place where the image forming apparatus 1 is emplaced is not a horizontally extending surface, it is possible to prevent occurrence of relatively large distortion of the frames 17. Accordingly, it is possible to prevent relatively large distortion of the belt.

Figure 7:
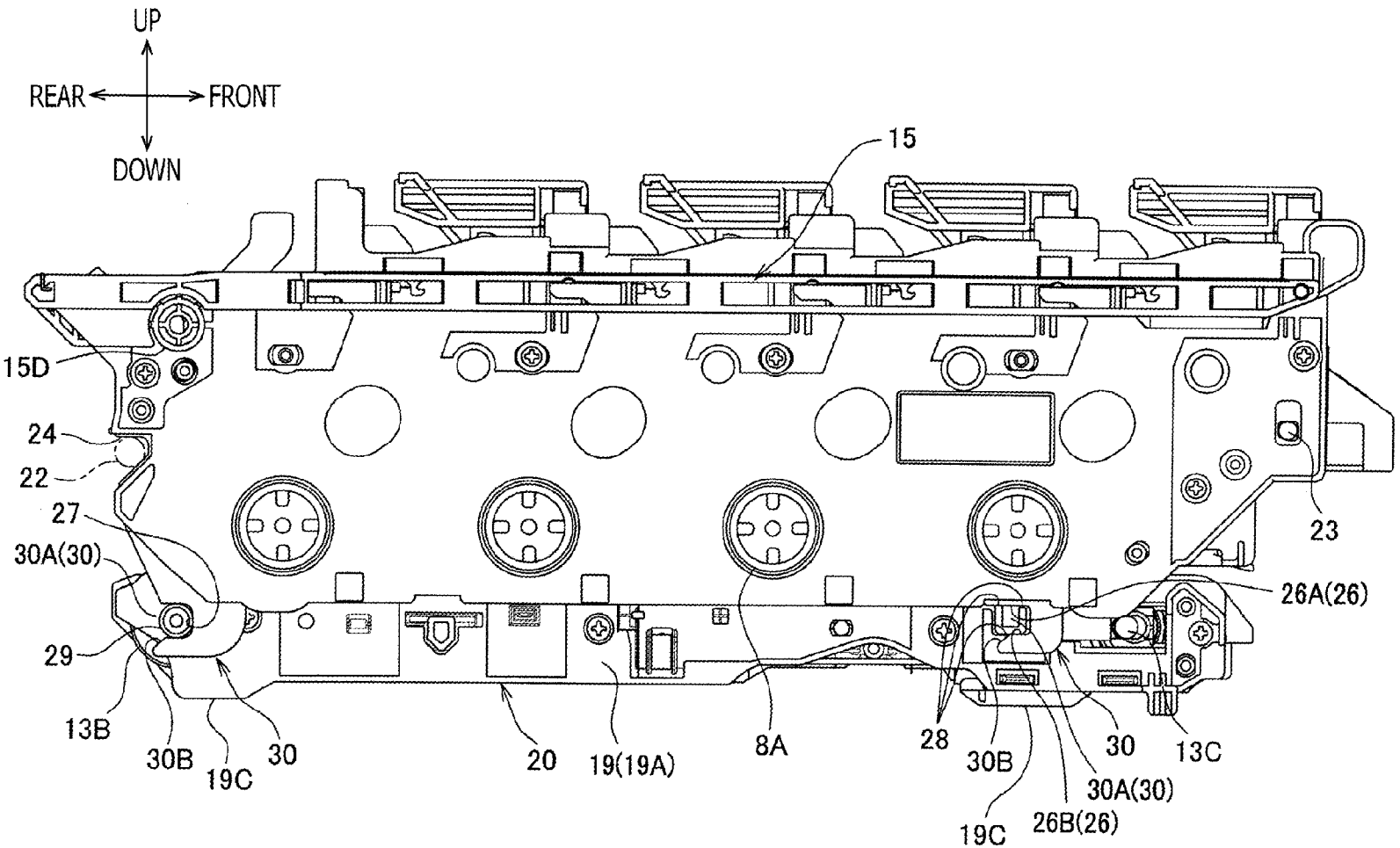
FIG. 7 is a side view showing the drawer to which the belt unit has been coupled.

According to the first illustrative embodiment, the second contacted parts 28 and 29 engage with the hooks 30 after entering though the openings 30A and contact the second contacting parts 26 and 27 (see FIG. 7). The openings 30A open to the direction parallel with the moving direction of the drawer 15. Because of such a structure, the belt unit 20 can be positioned relatively easily with respect to the drawer 15 in association with the movement of the drawer 15.

According to the first illustrative embodiment, the retracting side in the insertion direction (i.e., the rear side part) of each opening 30A open wider than the proceeding side in the insertion direction (i.e., the front side part). Therefore, the retracting side in the insertion direction of each opening 30A functions as a guiding part as mentioned above.

Therefore, even when the drawer 15 is drawn from the main body and thus the belt unit 20 is freely coupled with the main frames 17, it is possible to position the belt unit 20 with respect to the drawer 15 in association with the movement of the drawer 15.

According to the first illustrative embodiment, when the first contacting parts 21 and 22 contact the first contacted parts 23 and 24, the second contacting parts 26 and 27 contact the second contacted parts 28 and 29.

With the above configuration, when the first contacting parts 21 and 22 contact the first contacted parts 23 and 24 and the drawer 15 is positioned with respect to the main frames 17, the second contacting parts 26 and 27 contact the second contacted parts 28 and 29, and the belt unit 20 is positioned with respect to the drawer 15.

Figure 8:
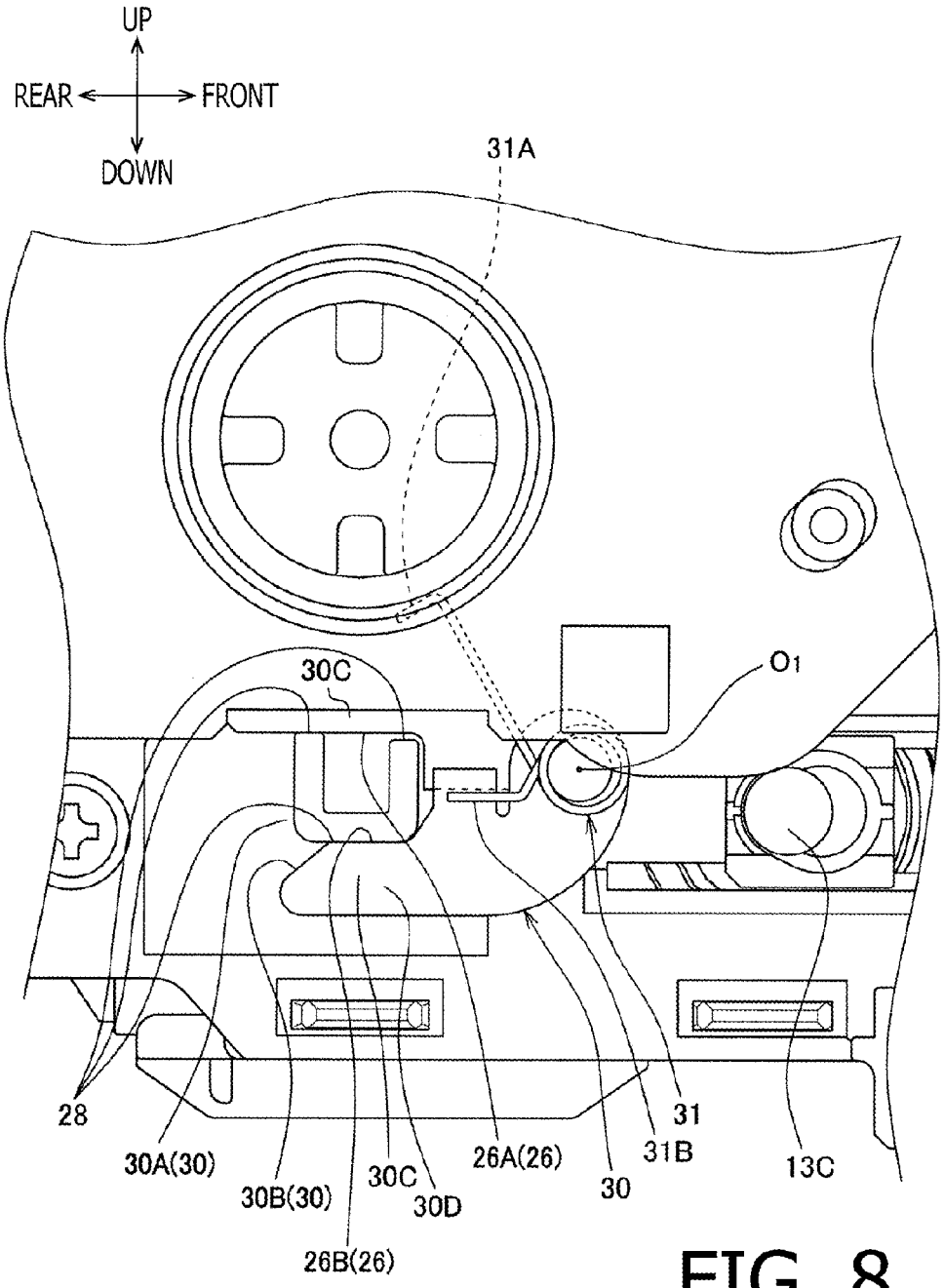
FIG. 8 is an enlarged view of a hook part according to a second illustrative embodiment.

As shown in FIG. 8, according to a second illustrative embodiment, springs 31 are additionally provided to increase pressure of contacting surfaces of the second front contacted parts 28 and the second front contacting parts 26.

According to the second illustrative embodiment, each hook part 30 is configured such that one of members 30C extending in the arranging direction and defining the opening 30A is displaceable with respect to the other. Specifically, according to the second illustrative embodiment shown in FIG. 8, the lower part 30C is displaceable with respect to the upper part 30C.

More specifically, the displaceable part 30C constitutes a movable part 30D which is a rotatable arm-like member rotatable about a center O1 defined at a position on the proceeding side in the insertion direction (i.e., on the second side in the arranging direction) with respect to the hook part 30. The spring 31 is arranged to apply an elastic force to elastically urge the movable part 30D toward the upper part 30C.

With the above structure, the second contacted parts 28 is urged toward the first parts 26A, and the second part 26B is urged toward the second front contacted parts 28. That is, pressure of contacting surfaces of each second front contacted part 28 and the corresponding second front contacting part 26 is increased by the spring 31. As a result, the displacement of the belt unit 20 in the up-and-down direction with respect to the drawer 15 is firmly restricted.

Each of the springs 31 is arranged such that one end portion 31A thereof is supported by the drawer 15, while the other end portion 31B is supported by the movable part 30D. According to the illustrative embodiment, each of the springs 31 is a torsion coil spring, and the coil part thereof is arranged to surround the center O1 of the rotation of the movable part 30D.

Figure 9:
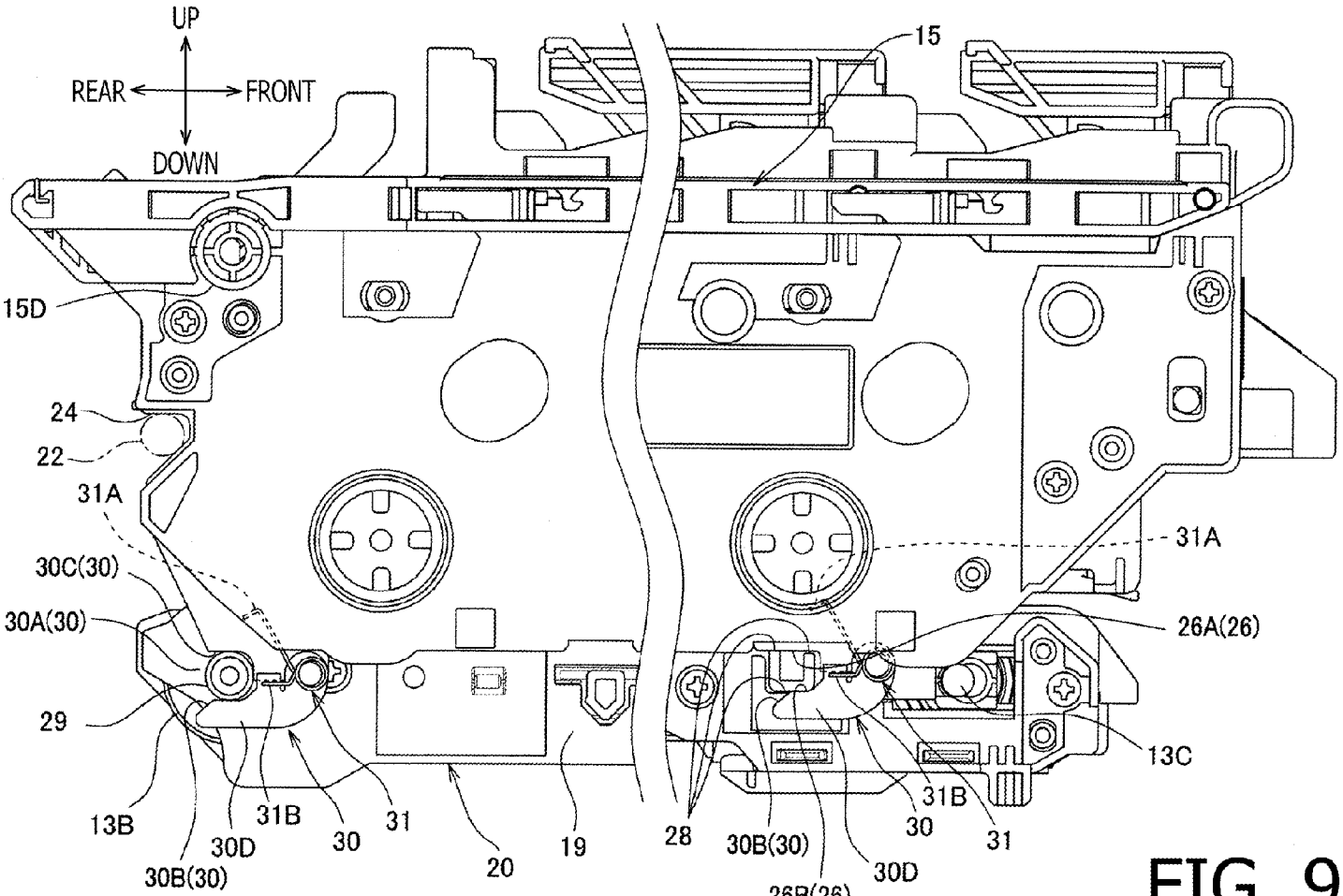
FIG. 9 is a side view of a drawer and the like according to the second illustrative embodiment.

It is noted that FIG. 8 shows the hook parts 30 arranged on the first side in the arranging direction (i.e., on the front side). As shown in FIG. 9, the hook parts 30 arranged on the second side in the arranging direction (i.e., on the rear side) have substantially the same structure.

That is, according to the second illustrative embodiment, the pressure of the contacting surfaces between the parts 30C and the second contacted parts 29. Therefore, also on the rear side, displacement of the belt unit 20 in the up-and-down direction with respect to the drawer 15 is firmly restricted.

According to the second illustrative embodiment, there are provided the springs 31 which urge at least the second contacted parts 28 toward the second contacting parts 26. Therefore, the position of the belt unit 20 can be held.

According to the second embodiment, one end portions of the springs 31 are supported by the drawer 15, but not by the main frames 17. Therefore, the elastic forces of the sprints 31 do not function to move the drawer 15 with respect to the main frames 17. As a result, it is possible to suppress a positional shift of the drawer 15 with respect to the main frames 17.

For example, if one ends of the springs 31 are supported by the main frames 17, the elastic forces generated by the springs 31 may work to displace the drawer 15 with respect to the main frames 17. According to the structure employed in the second illustrative embodiment, such a defect can be avoided.

According to the above-described illustrative embodiments, the second rear contacting parts 27 include surfaces extending perpendicular to the arranging direction. However, the aspects of the invention need not be limited to such a configuration. For example, each of the second rear contacting parts 27 may have two surfaces which intersect with the arranging direction but not parallel to each other.

According to the above-described illustrative embodiments, positioning in the arranging direction is done mainly on the first side in the arranging direction (i.e., on the rear side), and positioning in a direction perpendicular to the bridging surface 13A is done mainly on the second side in the arranging direction (i.e., on the front side). However, aspects of the invention need not be limited to such a configuration, and positioning in the arranging direction may be done mainly on the second side in the arranging direction (i.e., on the front side), and positioning in a direction perpendicular to the bridging surface 13A may be done mainly on the first side in the arranging direction (i.e., on the rear side).

According to the above-described illustrative embodiments, when the belt 13 starts proceeding obliquely, the end part in the width direction (i.e., axial direction) of the belt 13 contacts the flange part 13D formed at end portions of the driving roller 13B, and the movement of the belt 13 is corrected. However, aspects of the invention need not be limited to such a configuration.

For example, on a back surface of the belt 13, a guide belt protruding toward inside of the belt unit may be provided, while a groove for receiving the guide belt may be provided to the driving roller 13B for correcting the oblique proceeding of the belt 13. It is also possible to avoid deterioration of the belt at an early stage due to the oblique proceeding of the belt 13.

According to the illustrative embodiments, when the first contacting parts 21 and 22 contact the first contacted parts 23 and 24, respectively, the second contacting parts 26 and 27 contact the second contacted parts 28 and 29, respectively. However, the aspects of the invention need not be limited to such a configuration.

For example, the illustrative embodiments may be modified such that the belt unit 20 may be configured to be detached with the first contacting parts 21 and 22 contacting the first contacted parts 23 and 24 so that the drawer 15 is positioned with respect to the main frames 17.

According to the illustrative embodiments, the image forming apparatus 1 employs a direct method in which the developing agent images carried by the photoconductive drums 8 are directly transferred onto the sheet. It is noted that the aspect of the invention need not be limited to such a configuration. That is, the present invention can be applied to an image forming apparatus employing an intermediate transfer method in which the developing agent images carried by the photoconductive drums 8 are transferred on a belt, and then transferred to a sheet. In such a configuration, the illustrative embodiments may be modified such that the belt unit 20 is an intermediate transfer belt unit, which is positioned with respect to the drawer 15.

According to the second illustrative embodiment, one end of each spring 31 is directly supported by the drawer 15. However, the aspects of the invention need not be limited to such a structure. It may be sufficient if one end of each spring is directly or indirectly supported by the drawer 15 or the belt unit 20.

According to the second illustrative embodiment, the coil springs 31 are torsion coil springs. However, the aspects of the invention need not be limited to such a configuration. For example, the springs may be coil springs.

It is noted that the present invention is defined in claims and should not be limited to the configuration of the illustrative embodiments and modifications.

What is claimed is:

1. An image forming apparatus comprising:

a plurality of photoconductive drums arranged along an arranging direction, rotation axes of the plurality of photoconductive drums being arranged in parallel;

a drawer configured to be movable between a coupled position and an uncoupled position while holding the plurality of photoconductive drums;

a pair of frames arranged on both sides in an axial direction of the plurality of photoconductive drums, the pair of frames having drawer supporting parts configured to movably support the drawer;

a belt unit having an endless belt configured to proceed in the arranging direction, the endless belt having an extending surface which is configured to contact the plurality of photoconductive drums and a plurality of transfer members;

belt unit supporting parts respectively provided to the pair of frames, the belt unit supporting parts supporting the belt unit when the drawer is in the coupled position and when the drawer is in the uncoupled position;

first contacting parts respectively provided to the pair of frames, the first contacting parts contacting first contacted parts provided to the drawer to position the drawer with respect to the pair of frames; and second contacting parts provided to the drawer, the second contacting parts contacting second contacted parts provided to the belt unit to position the belt unit with respect to the drawer, wherein, only when the drawer is located at the coupled position with the belt unit being supported by the belt unit supporting parts:

the drawer is positioned with respect to the pair of frames as the first contacting parts contact the first contacted parts, respectively; and the belt unit is positioned with respect to the drawer as the second contacting parts contact the second contacted parts, respectively.

2. The image forming apparatus according to claim 1, wherein the extending surface is arranged to extend horizontally.

3. The image forming apparatus according to claim 1, wherein the arranging direction is a horizontal direction.

4. The image forming apparatus according to claim 1, wherein the drawer supporting parts are configured to allow the drawer to move in the arranging direction.

5. The image forming apparatus according to claim 1, wherein:

the first contacting parts are provided on a first side portion and a second side portion which is an opposite side portion to the first side portion in the arranging direction;

the first contacted parts are provided on the first side portion and the second side portion in the arranging direction;

the first contacting parts and the first contacted parts provided on the first side portion determine a position of the drawer relative to the pair of frames in the arranging direction; and the first contacting parts and the first contacted parts provided on the opposite side portion determine a position of the drawer relative to the pair of frames in a direction perpendicular to the extending surface of the endless belt.

6. The image forming apparatus according to claim 1, wherein:

the second contacting parts are provided on a first side portion and a second side portion which is an opposite side portion to the first side portion in the arranging direction;

the second contacted parts are provided on the first side portion and the second side portion in the arranging direction;

the second contacting parts and the second contacted parts provided on the first side portion determine a position of the belt unit relative to the drawer in the arranging direction; and the second contacting parts and the second contacted parts provided on the second side portion determine a position of the belt unit relative to the drawer in a direction perpendicular to the extending surface of the endless belt.

7. The image forming apparatus according to claim 1, wherein:

ones of the second contacting parts and the second contacted parts are formed to be inserted through openings of other ones of the second contacting parts and the second contacted parts, the second contact parts and the second contacted parts being engaged with each other; and each of the openings is opened toward a direction parallel to a movable direction of the drawer.

8. The image forming apparatus according to claim 7, wherein a part of each of the openings on a retracting side in an insertion direction is opened wider than a forward side in the insertion direction.

9. The image forming apparatus according to claim 1, further comprising an urging mechanism configured to urge the second contacted parts toward the second contacting parts.

10. The image forming apparatus according to claim 9, wherein the urging mechanism includes springs urging the second contacted parts toward the second contacting parts, respectively.

11. The image forming apparatus according to claim 10, one end of each spring in a deforming direction is supported by one of the drawer and the belt unit.

12. The image forming apparatus according to claim 9, one end of each spring in a deforming direction is directly supported by one of the drawer and the belt unit.

13. The image forming apparatus according to claim 1, wherein:

the drawer comprises a pair of side walls; and each of the plurality of photoconductive drums is positioned with respect to the pair of side walls.

14. The image forming apparatus according to claim 13, wherein the pair of side walls support flange parts of each of the plurality of photoconductive drums, respectively.

15. The image forming apparatus according to claim 1, wherein:

the first contacted parts include a pair of first contacted parts provided at a first side portion and a second side portion which is an opposite portion of the drawer to the first side portion in the arranging direction, respectively;

the second contacting parts include a pair of second contacting parts provided at the first side portion and the second side portion of the drawer, respectively; and the pair of second contacting parts are provided between the pair of first contacted parts in the arranging direction.

* * * * *